United States Patent [19]

Herbst et al.

[11] 4,252,264

[45] Feb. 24, 1981

[54] TWO-PIECE SCOOP AND SERVING CONTAINER WITH INTERNAL AND EXTERNAL DECOR AND METHOD FOR APPLYING SUCH DECOR

[75] Inventors: David H. Herbst, Reisterstown; Patrick T. Boyle, Baltimore, both of Md.

[73] Assignee: Maryland Cup Corporation, Owings Mills, Md.

[21] Appl. No.: 28,840

[22] Filed: Apr. 10, 1979

Related U.S. Application Data

[63] Continuation-in-part of Ser. No. 953,103, Oct. 20, 1979.

[51] Int. Cl.[3] ..... B65D 5/36

[52] U.S. Cl. ..... 229/1.5 B; 229/21; 141/108; 294/55

[58] Field of Search ..... 229/1.5 B, 21; 294/55; 141/108, 109

[56] References Cited

U.S. PATENT DOCUMENTS

| | | | |
|---|---|---|---|
| 203,885 | 5/1978 | Button | 294/55 |
| 1,548,682 | 8/1925 | Gulin | 229/21 X |
| 1,931,213 | 10/1933 | Wheeler | 229/21 X |
| 1,996,431 | 4/1935 | McKicham | 229/1.5 B |
| 2,112,959 | 4/1938 | Harvey | 229/21 |
| 2,540,565 | 2/1951 | Barbieri | 229/21 X |
| 2,540,707 | 2/1951 | Beukelman | 229/21 |
| 3,845,897 | 11/1974 | Buttery et al. | 229/1.5 B X |
| 3,929,271 | 12/1975 | Meyers | 229/21 X |

*Primary Examiner*—Davis T. Moorhead

*Attorney, Agent, or Firm*—Birch, Stewart, Kolasch & Birch

[57] ABSTRACT

A two-piece frustoconical container is provided with a scalloped sidewall having a lowermost depressed edge portion opposite to an uppermost edge portion in a scoop configuration engageable with foods in bulk as a scoop. When filled with food product the container will stand alone. A lapped side seam extends from the base to the uppermost edge portion to lend stiffness to the scoop configuration. A parallel vertical strip decor is provided over the major portion of the interior surface of the container and is printed thereon by a method which obviates the need to provide registry of the printing on the front and back surfaces of the strip stock from which each sidewall blank is cut. The rear surface of the strip stock is printed with a parallel chevron design, with or without occlusion of the apices of the chevrons, as desired, the apices and the printed sidewall blanks on the front surface being centered on the strip stock and the legs of the chevrons being at the same included angle and orientation as the side seam-forming ends of the sidewall blank. When the sidewall blanks are blanked (cut) from the strip stock and the ends lapped to form a side seam, the stripes at the seam and around the major portion of the interior of the thus formed frustoconical sidewall will appear parallel and be vertically disposed between the bottom and open end of the container.

6 Claims, 6 Drawing Figures

TWO-PIECE SCOOP AND SERVING CONTAINER WITH INTERNAL AND EXTERNAL DECOR AND METHOD FOR APPLYING SUCH DECOR

CROSS REFERENCE TO RELATED APPLICATIONS

This application is a Continuation-in-Part of application Ser. No. 953,103, filed on Oct. 20, 1979.

FIELD OF THE INVENTION

This invention relates to a combined scoop and serving container and more particularly, to a two-piece basically frustoconical scoop and serving cup combination for the sale of measured portions of french fried potatoes and the like.

BACKGROUND OF THE INVENTION

In the prior art, there are at present collapsible french fry scoops and serving containers which must be assembled from a collapsed position into an upstanding or modified condition prior to ingesting substantially measured quantities of french fried potatoes therein for the purpose of dispensing these measured quantities of potatoes to retail customers and the like.

Also, such prior art containers are not basically capable of standing upright but require sloping supports or other ancillary equipment at the point of purchase in order to properly present them to retail customers in fast-food establishments and the like.

The scooped out center portion of the sidewall blank forms the lowermost edge portion of the mouth of the scoop or skuttle configuration. The position of this lowermost edge portion defines the front of the container, thereby rendering the interior surface of the high back portion of the scoop, including the lapped side seam, the apparent obverse surface of the interior of the container.

For aesthetic reasons, when the supply of french fries or other food products in a container are substantially depleted by customer consumption, a vertical parallel line pattern printed or otherwise applied to the interior obverse surface of the container, with the pattern lines parallel to the side seam, is desirable. This pattern is oriented in a substantially similar manner to the elongated french fries and the lines are suggestively similar in configuration to the french fries. Thus, the container appears less empty to the consumer of the contents thereof at any given stage of consumption.

However, in forming such a pattern on the obverse interior surface of a frustoconical container of the present invention which is conventionally formed from the arcuate cup blanks of the present invention, blanked from continuously fed strip stock, the geometry of these blanks requires that the printing on the two surfaces of the strip stock be in full registry. This presents undesirable cost and quality control factors.

It is therefore an object of the present invention to provide a new and novel combined scoop and french fry serving container.

It is another object of the present invention to provide a new and novel two-piece frustoconical scoop and serving container for french fries and the like in the form of a conventional paper cup with a scalloped upper edge.

Still another object of the present invention is to provide a two-piece scoop and serving container which is self-supporting in an upright content-displaying position and which is stackable in a fully open and ready to use condition.

Yet another object of the present invention is to provide a printing method for providing a substantially vertical parallel line pattern over a major portion of the interior surface of a frustoconical container, parallel to the side seam, which obviates the need for registry of the patterns printed on opposite faces of the strip stock.

These and other objects of the present invention will become more fully apparent with reference to the following specification and drawings which relate to a preferred embodiment of the invention.

SUMMARY OF THE INVENTION

Basically, the combined scoop and serving container is constructed in the manner of a two-piece frustoconical paper cup or the like having a sidewall blank with a lapped side seam, a bottom disc having a downturned flange thereon and a bottom curl formed on the sidewall portion of the cup which engages the skirt portion to form a bottom curl and seam configuration at the lower closed end of the container upon which the container will be self-supporting and stand upright.

The sidewall blank is cut with a substantially symmetrical curvature which is caused to dip towards the lowermost extremity thereof at its center such that the resulting two-piece frustoconical cup structure has a scoop or skuttle configuration at the upper periphery thereof. Also, the side seam acts to stiffen the uppermost portion of the top edge of the scoop. This is the portion of the scoop that first engages bulk quantities of the foods to be scooped up thereby.

The resulting structure will nest one within the other as in the case of paper and plastic two-piece frustoconical cups and the like and at the same time provide a scoop configuration whereby french fries or other similar food products may be scooped up and subsequently served in the same container.

In providing the interior parallel line pattern in the present invention, instead of printing two discrete patterns in registry on each surface of a given sidewall blank in a sequence of such blanks on stock strip, the external blank surface pattern is printed centered across the stock strip and on the opposite surface of the stock is printed a chevron pattern of parallel chevrons having their apices located along the longitudinal center line of the stock strip, their legs extruding to the outboard edges of the stock strip, and the included angle of the legs being equal to the included angle of the side edges of the sidewall blank which are to form the side seam in the finished container.

In this manner, the lapping of the side edges of the sidewall blank will result in a pattern of apparently vertical and parallel lines on the obverse interior surface of the container. The chevron apices and the convergence of the legs of the chevrons will be concealed from view behind the lowermost portion of the container sidewall.

This precludes the need for printing two patterns in registry on both sides of a stock strip while providing the particular aesthetic pattern required on the obverse portion of the frustoconical interior surface of the combined scoop and serving container.

The preassembled nature of the frustoconical two-piece cup-like container and its stackability provide a much more facile and efficient means by which sanitary scooping and serving containers can be made available to personnel in fast food establishments and the like.

Also, scrap is minimized and the blanked-out shapes required to produce the containers are very simplistic thereby eliminating the complexity of the folded blanks of present-day devices.

DETAILED DESCRIPTION OF THE DRAWINGS

Figure 1:
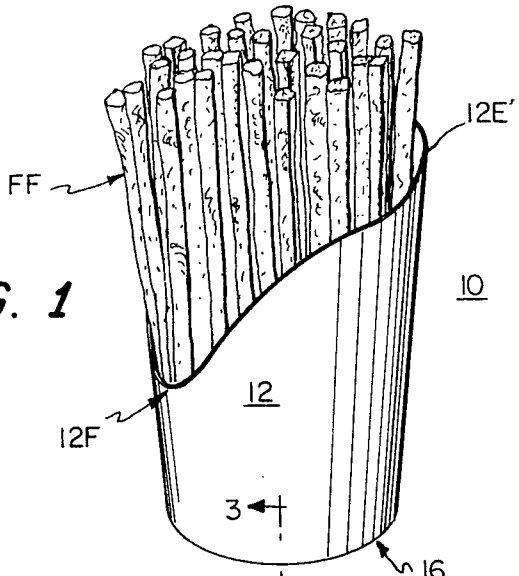
FIG. 1 is a perspective of a combined scoop and serving container of the present invention which is filled with food product.
Figure 3:
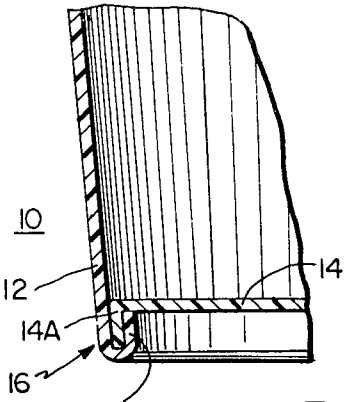
FIG. 3 is a cross-section of the bottom curl of the scoop and container of the present invention taken along line 3—3 of FIG. 1.
Figure 2:
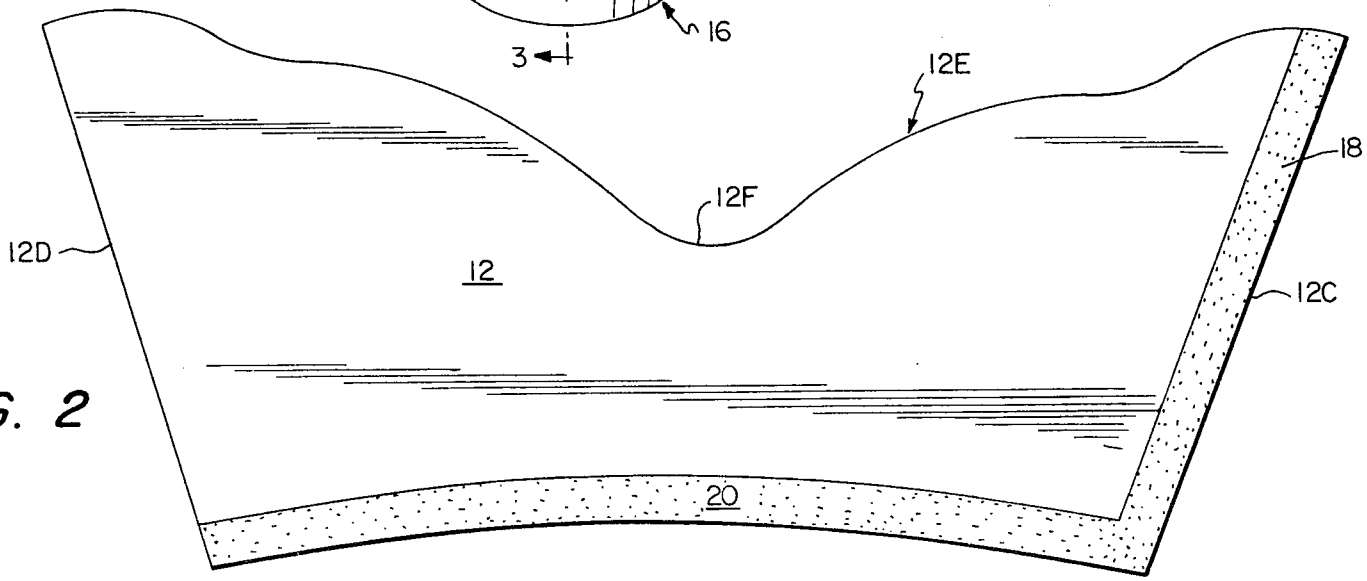
FIG. 2 is a plan view of a typical sidewall blank of a preferred embodiment of the present invention.

Referring jointly to FIGS. 1, 2 and 3 of the drawings, the combined scoop and serving container 10 is shown as including a sidewall portion 12, a bottom disc or closure 14 having a dependent skirt portion 14A which when joined with a U-shaped reentrant bend 12A on the sidewall forms a bottom curl configuration 16.

As shown in FIG. 2, a side seam glue line 18 defines an area of overlap between a first edge 12C and the opposite edge 12D of the sidewall blank 12 illustrated in FIG. 2 and another glue-containing area 20 is provided to define the area of the bottom curl in which the reentrant bend 12A is effected.

The uppermost edge 12E of the sidewall blank 12 is provided with a central dip portion or arcuate depression 12F from which the remainder of the upper edge 12E proceeds in a series of substantially symmetrical stepped curves to the upper apices of the side edges 12C and 12D. This series of stepped curves from the low point or arcuate depression 12F in the upper edge 12E provides the scooped or skuttle shape illustrated in FIG. 1.

The uppermost reach of the top edge 12E of the container 10 comprises that portion of the container 10 which first engages the food product when the container 10 is utilized as a scoop. In the scoop mode of operation, the thumb of a user, for example, is reposed in the arcuate depression 12F illustrated in the finished scoop and container 10 of FIG. 1 with the forefinger and other fingers placed beneath the bottom curl 16 such that french fries or the like are ingested into the container in a substantially measured quantity for subsequent dispensing to customers.

Accordingly, in order to provide increased rigidity at the uppermost point of the top edge 12E, a lapped side seam along the glue line or area 18 consisting of the overlapped edges 12C and 12D of the sidewall 12 provides a two-ply stiffened reinforcement from the bottom curl 16 all the way up sidewall 12 to the uppermost portion of the scalloped edge 12E to provide additional strength and stiffness to this food contacting portion of the scoop-shaped receptacle 10.

Once filled with food products such as the french fries FF, the container 10 will stand vertically on its own as clearly illustrated in FIG. 1. This presents a stable and highly attractive display to the potential customer about to purchase a given portion of contained french fries and the like.

Figure 4A:
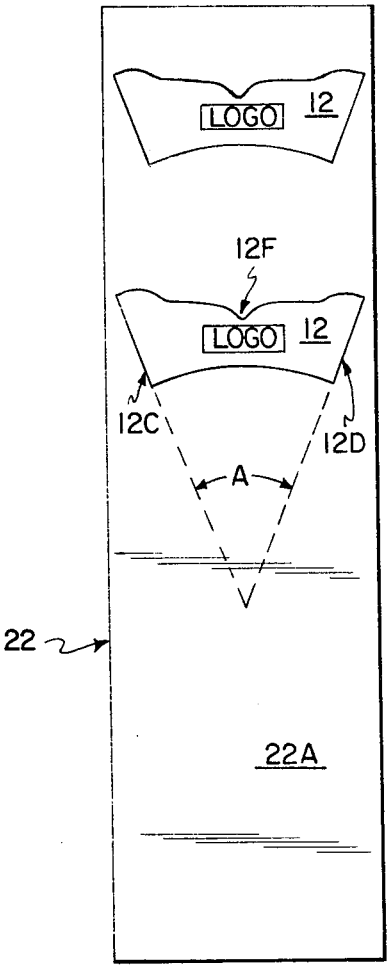
FIGS. 4A and 4B are side-by-side presentations, respectively, of the exterior and interior surface patterns of cup blanks as seen from opposite faces of the same segment of a stock strip.
Figure 4B:
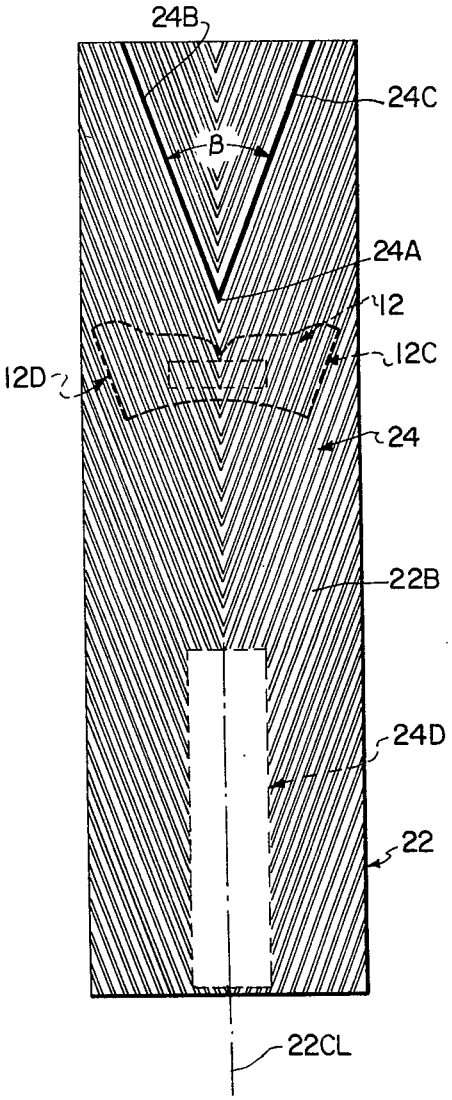

Referring now to FIGS. 4A and 4B, a plurality of sidewall blanks 12 are illustrated in FIG. 4A on the surface 22A of a strip of blank stock 22 in which the blanks 12 extend substantially from one side edge of the strip stock 22 to the other and the side edges 12C and 12D of the sidewall blanks 12 define an included angle A as illustrated in FIG. 4A.

The reverse or opposite surface 22B of the same length of strip stock 22 is provided with a chevron pattern 24 with each individual chevron including an apex 24A positioned along the longitudinal center line 22CL of the strip of stock 22 indicated in dotted lines in FIG. 4B and having left and right legs 24B and 24C, respectively, defining an included angle B substantially identical to the included angle A on the surface 22A as defined by the side edges 12C and 12D of the cup blank.

If desired, the apices 24A of the chevron pattern 24 can be omitted such as in the area 24D defined by the dotted rectangle at the lowermost portion of the surface 22B in FIG. 4B.

Figure 5:
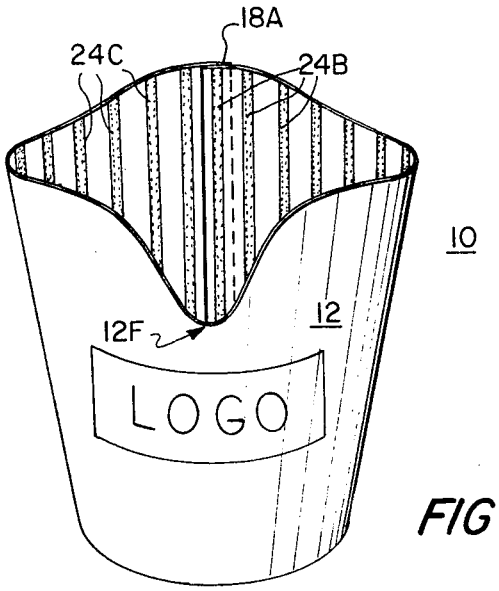
FIG. 5 is a front elevation of a finished container illustrating the desired parallel and vertical line pattern on the obverse portion of the interior surface of the container.

Referring next to FIG. 5, the container 10 of the present invention is illustrated in a front elevation with the vertical stripes to the left of the side seam 18 being comprised of parallel chevron arms 24C and those to the right of the side seam 18 being comprised of the chevron arms 24B, the illustration of FIG. 4B being rotated 180° from its illustrated position when in its printed position on the back of the strip stock 22 in FIG. 4A.

As seen from FIGS. 4A and 4B, the arm 24C will be parallel to the side edges 12C and the arms 24D will be parallel to the side edges 12D of the cup blanks 12 on the strip of stock 22. This fact of relative orientation with respect to the dimensions of the strip of stock 22 of the cup blanks 12 and the chevron pattern 24 provides the necessary geometric relationship to achieve the desired substantially vertical and parallel line pattern on the interior obverse surface of the container 10 while simultaneously obviating the need to place individual printing plates in registry front to back with respect to the surfaces 22A and 22B of the strip of stock 22.

As further illustrated in FIG. 4B, a sidewall blank is illustrated in dotted lines centrally of the surface 22B to show how the pattern of chevrons 24 is superimposed upon the sidewall blank 12.

It should be understood that the two-piece scoop and serving container with internal and external decor and method for applying such decor of the present invention may be modified as would occur to one of ordinary skill in the art without departing from the spirit and scope of the present invention.

It is claimed:

1. For a combined scoop and serving container for food products comprising a frustoconical drinking cup structure having a closed base and an upstanding sidewall; said sidewall having a scalloped configuration extending, symmetrically, from a lowermost curved portion to a substantially opposed uppermost curved portion to define an open scoop; and said uppermost curved portion comprising the initial food-engaging portion of said scoop; said lower curved portion being directed downwardly to expose a substantial portion of the interior surface of the container to define an obverse interior surface and a substantially vertical parallel line pattern applied to said obverse interior surface and extending from top to bottom of said sidewall; the invention comprising:

a sidewall blank of generally arcuate configuration at its lowermost extremity, a pair of divergent side edges extending from said lowermost extremity to an uppermost edge portion adjacent the uppermost end of each said side edges defining an included angle;

said uppermost edge portions being connected by a scalloped edge having a centrally located lowermost edge portion;

said lowermost edge portion defining the said lowermost curved portion of said sidewall and said uppermost edge portions together defining the said uppermost curved portion of said sidewall when said side edges are lapped in parallel to form a vertical side seam; and a pattern of chevrons on the inside surface of said blank and having apices aligned substantially centrally of said blank and legs extending parallel to said side edges to define the same included angle therebetween to provide said substantially vertical parallel line pattern adjacent to and parallel to said side seam and throughout said obverse interior surface.

2. The method of providing a frustoconical container sidewall having a vertical side seam and a substantially parallel line interior surface decor on both sides of and parallel with the side seam, comprising the steps of:

providing an elongated strip of stock with substantially parallel side edges;

printing at least one arcuate sidewall blank on said stock transversely thereof and substantially centered thereon with divergent side edges defining a first included angle adjacent each side edge of said strip of stock;

printing a pattern of parallel chevrons on the opposite face of said strip of stock with each said chevron including an apex and two legs defining a second included angle substantially equal to said first included angle, the apices of said chevrons being substantially on the longitudinal center line of said strip and the legs of said chevrons being substantially parallel to respective ones of the said divergent side edges of said arcuate blanks;

cutting said arcuate blanks from said strip of stock; and folding said arcuate blank until said side edges are overlapped in parallel to form a side seam to define a frustoconical sidewall having said substantially parallel line pattern consisting of the legs of said chevrons on either side of and parallel with said side seam on the interior surface of said frustoconical sidewall.

3. The product by the process of claim 2.

4. A non-collapsible combined scoop and serving container for food products comprising:

a frustoconical drinking cup structure having a closed base and an upstanding sidewall, said closed base including a bottom disc affixed to said sidewall, said sidewall having a scalloped configuration extending, symmetrically, from a lowermost curved portion to a substantially opposed uppermost curved portion to define an open scoop, said lowermost curved portion being directed downwardly to provide a gripping means on the sidewall and to expose an obverse interior surface to said container, a vertical lapped side-seam in said sidewall, said side-seam extending from said closed base to said uppermost curved portion on said sidewall to lend stiffness to said open scoop, said uppermost curved portion comprising the initial food engaging portion of said scoop; and chevron line patterns on said obverse interior surface having apices substantially vertically aligned beneath the lowermost curved portion and passing from said apices into lines parallel with the side-seam at a point adjacent said side-seam and apparently parallel one to another to an observer throughout said obverse interior surface.

5. A non-collapsible combined scoop and serving container for food products comprising:

a frustoconical drinking cup structure having a closed base and an upstanding sidewall, said closed base including a bottom disc affixed to said sidewall, said sidewall having a scalloped configuration extending, symmetrically, from a lowermost curved portion to a substantially opposed uppermost curved portion to define an open scoop, said lowermost curved portion being directed downwardly to provide a gripping means on the sidewall, a vertical lapped side-seam in said sidewall, said side-seam extending from said closed base to said uppermost curved portion on said sidewall to lend stiffness to said open scoop, said uppermost curved portion comprising the initial food engaging portion of said scoop.

6. The invention of claim 5, wherein said closed base further comprises a dependent annular skirt on said bottom disc and a reentrant bend in said sidewall interengaged with and sealed to said dependent annular skirt.

* * * * *